US007581747B2

(12) United States Patent
Kosmehl

(10) Patent No.: US 7,581,747 B2
(45) Date of Patent: Sep. 1, 2009

(54) SNOWBOARD

(76) Inventor: Patrick-Alexander Kosmehl, Breiteweg 81, D-39179 Barleben (DE)

( * ) Notice: Subject to any disclaimer, the term of this patent is extended or adjusted under 35 U.S.C. 154(b) by 725 days.

(21) Appl. No.: 10/553,513

(22) PCT Filed: Apr. 16, 2004

(86) PCT No.: PCT/DE2004/000799

§ 371 (c)(1),
(2), (4) Date: Jan. 9, 2006

(87) PCT Pub. No.: WO2004/094009

PCT Pub. Date: Nov. 4, 2004

(65) Prior Publication Data

US 2006/0119053 A1 Jun. 8, 2006

(30) Foreign Application Priority Data

Apr. 19, 2003 (DE) ..... 203 06 244 U

(51) Int. Cl.
*B62B 13/00* (2006.01)

(52) U.S. Cl. ..... 280/601; 280/607; 280/609; 280/14.21

(58) Field of Classification Search ..... 280/601, 280/607, 609, 11.14, 14.21, 14.22, 14.25, 280/14.26
See application file for complete search history.

(56) References Cited

U.S. PATENT DOCUMENTS

| | | | | |
|---|---|---|---|---|
| 4,647,062 | A * | 3/1987 | McDougall | 280/607 |
| 4,951,960 | A * | 8/1990 | Sadler | 280/607 |
| 5,458,370 | A * | 10/1995 | Melcher | 280/817 |
| 5,551,728 | A * | 9/1996 | Barthel et al. | 280/818 |
| 5,558,354 | A * | 9/1996 | Lion | 280/607 |
| 6,113,115 | A * | 9/2000 | Hurth | 280/15 |
| 6,293,567 | B1 * | 9/2001 | Menges | 280/14.21 |
| 6,352,268 | B1 * | 3/2002 | Peart | 280/14.21 |
| 6,682,083 | B2 * | 1/2004 | Melcher | 280/14.26 |
| 7,484,738 | B2 * | 2/2009 | Belt | 280/14.26 |

FOREIGN PATENT DOCUMENTS

| | | |
|---|---|---|
| CA | 2 370 637 | 9/2001 |
| DE | 34 44 345 | 6/1986 |
| DE | 36 02 006 | 7/1987 |
| DE | 198 20 619 | 11/1999 |
| DE | 198 20 619 A1 | 11/1999 |
| DE | 201 13 739 | 4/2002 |
| DE | 201 13 739 U1 | 4/2002 |
| DE | 202 17 713 | 3/2003 |
| FR | 25 22 976 | 9/1983 |
| WO | WO 01/64300 | 9/2001 |

* cited by examiner

*Primary Examiner*—Christopher P Ellis
*Assistant Examiner*—Brian Swenson
(74) *Attorney, Agent, or Firm*—Collard & Roe, P.C.

(57) ABSTRACT

A snow board having an elongated body with concavely curved side margins and an elongate web in its center separated from the body by lateral slots and joined with the forward and rear sections of the body in a curved configuration.

10 Claims, 1 Drawing Sheet

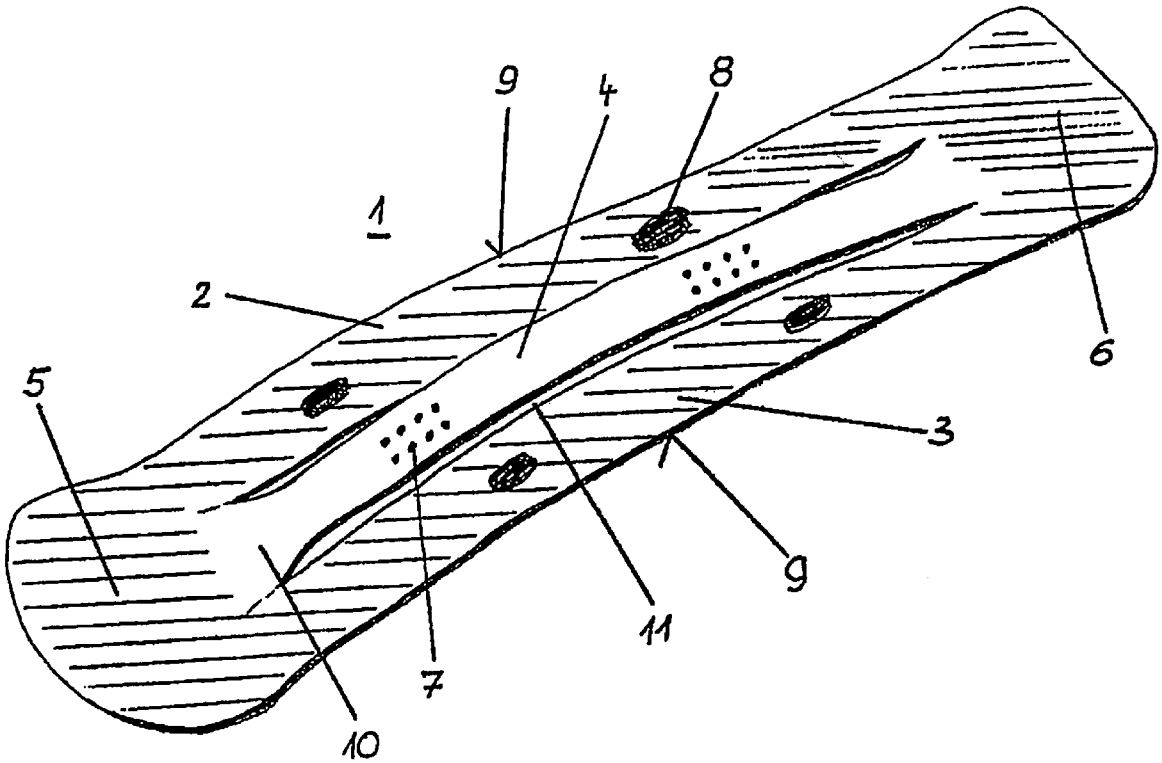
9
4
8
1
2
6
5
3
9
11
7
10

SNOWBOARD

BACKGROUND OF THE INVENTION

1. Field of the Invention

The invention relates to a snow board with a divided gliding surface.

2. The Prior Art

In recent years various solutions have become known which relate to the configuration as well as to the technical feasibility of snow boards. These changes relate to snow boards of conventional manufacture as unitary structures as well as to snow boards of divided structure.

The configuration of snow boards as divided structures in particular is to yield improved support structures and flexibility of snow boards. It proceeds upon the general recognition, and with due consideration of the variously constructed runways, that the flexibility of a snow boards has a significant effect upon its motion characteristics. When running along curves the properties of a snow board are determined by its laterally concave waistline.

The vertical flexibility of a snow board, i.e. its resilient resistance against upward and downward movements of its end sections, significantly affects its motion characteristics. When a snow board is gliding longitudinally over snow with its full surface in engagement therewith it is necessary by a properly designed flexibility that in dents the two ends of the snow board flex upwardly relative to the middle sections and that over projections or elevations it provides for a certain counter flexing.

The properties of a snow board moving along curves are determined on the one hand by its waistline—the center section is generally narrower than its end sections—and, on the other hand, by the flexibility of the longitudinal edge facing the inside of the curve. When moving in a curve, the snow board is tipped, i.e. it tilts laterally; so that only its longitudinal edge at the inside of the curve is in contact with snow whereas the edge at the outside of the curve is lifted more or less off the snow.

German utility model specification DE 201 13 739 U1 describes a snow board of a unitary body structure with a slot extending essentially along its center axis from the rear end of the board to at least its central area, thus forming two separate arms connected by the unitary front section. The slot divides the gliding surface of the snow board into two separate gliding surfaces which may have a positive effect on the gliding resistance, yet it has resulted in a change in the typical snow board structure by substantially reducing the narrow center section such that it has a negative effect upon running in curves.

A snow board with a divided gliding surface is disclosed by German specification DE 198 20 619 A1 for providing an improved pressure distribution profile to make snow boarding sensitive and controlled. The drawback of this solution is that for running the two separate gliding surfaces must, of course, be connected such that the desired advantages are attained. This is to be accomplished by a spring and dampening spacer element mounted on the two gliding components between the support plate and the gliding surface at the two gliding members. This type of connection is technologically and economically complex and necessitates a different kind of binding between the snow board and the shoe different from the structure of conventional bindings and very complicated in structure.

OBJECT OF THE INVENTION

It is thus an object of the invention to develop a snow board with a divided gliding surface for improving straight running as well as running in curves.

BRIEF SUMMARY OF THE INVENTION

In accordance with the invention this is accomplished by a snow board having a basic body consisting of two gliding members and an elongate web provided between the gliding members, slots being provided between the gliding members and the elongate web and the transition sites between the elongate web and the forward and rear sections of the basic body being curved.

Special embodiments and advantageous features are the subject of the subclaims.

The invention is based upon the recognition that the practice-proven properties of conventional snow boards as regards their configuration, structure and manufacturing process should be retained as far as possible while substantially improving the operational properties of the snow board relative to known solutions.

Thus, a snow board has been made the board of which consists of a basic body structured such that in its longitudinal shape it is provided with lateral gliding members which constitute the gliding surfaces of the snow board and that in its center it is provided with a support surface structured as an elevated elongate web.

As an element of the invention the gliding members and the elongate web are formed in the board such that at the front and rear sections of the snow board they blend into closed forward and rear elements thus creating a one-piece snow board with divided gliding surfaces.

Particular emphasis was placed upon the snow board providing or including the advantages of a one-piece snow board by the width of its forward and rear sections corresponding to that of conventional snow boards.

Another element of the invention is that in its middle section the snow board has a waistline formed by the longitudinal shape of its two gliding members.

While the lower surfaces constitute the gliding surfaces of the snow board, the support surface which would bear a the user, is formed by an elongate web which is provided with appropriate brackets, e.g. inserts, for attaching commercially available bindings. Preferably, the elongate web is spaced about 3 cm to 5 cm from the lateral gliding members so that the two gliding surfaces with their gliding members are distinct and blend or transition into the forward and rear full-surface gliding areas of the snow board.

The configuration of the snow board with an elevated elongate web yields two substantial advantages. As a result of the divided gliding surfaces the flexibility of the snow board is increased, which favorably affects its running properties, and the gliding resistance or friction is reduced.

Not only does the elevated elongate web lead to increased flexibility of the snow board, but it also improves its functionality, especially for running in curves. The difference in height between the elongate web and the lateral gliding members, i.e. the space between bindings and gliding members, is compensated by providing spacers on the surfaces of the gliding members in the area of the bindings. The thickness of the spacers equals the difference in height between the gliding members and the elongate web. The spacers may be attached on the surfaces of the gliding members by adhesive. Advantageously, analogous to the fastening of the bindings on the elongate web, the spacers are replaceably and adjustably mounted which positively affects manufacture and costs.

In a further embodiment of the invention the differences in height between the gliding members and the elongate web may be compensated by spacers mounted on the bindings at their engagement surfaces at the toe and heel portions. The height of such spacers would be the same as the difference in height between the elongate web and the gliding members. Such an arrangement would satisfy the requirement or desire of those users who prefer to run the snow board with their feet in varying positions. At the same time, the pressure on the gliding surface is increased during use of the snow board, and the stability is improved.

In accordance with the present invention the variability of the foot positions on the snow board is brought about by guide rails provided on or in the elongate web and extending in the longitudinal direction of the snow board. The bindings are mounted on the rails for longitudinal adjustment.

The unitary structure of the snow board also yields advantages as regards its manufacture. Thus, the snow board may be made of plastic, fibers or wood, as well as of other materials which positively affect manufacturing techniques and economies.

The snow board in accordance with the present invention offers reduced friction or gliding resistance between its gliding surfaces and snow as well as significantly reduced noise. In the snow board, the properties of three different types of snow boards are united, so that, at appropriate widths, it can be used as a racing board, as a general purpose snow board as well as a deep-snow board.

DESCRIPTION OF THE DRAWING

The novel features which are considered to be characteristic of the invention are set forth with particularity in the appended claims. The invention itself, however, in respect of its structure, construction and lay-out as well as its manufacturing techniques, together with other advantages and objects thereof, will be best understood from the description herein set forth of preferred embodiments when read in connection with the appended sole drawing which is a perspective view of the snow board in its entirety.

DETAILED DESCRIPTION OF THE PREFERRED EMBODIMENT

The accompanying drawing directly illustrates the configuration of the snow board 1 in its entirety, showing it as a unitary board. The snow board 1 consists of two gliding members 2 and 3 formed at the two longitudinal sides of the snow board 1. The gliding members 2 and 3 are spaced at a certain distance from each other which is determined by the arrangement and structure of an elongate web 4 extending from a forward area 5 of the snow board 1 to a rear area 6 and having a preferred height of up to 5 cm above the gliding members 2 and 3. Gliding members 2 and 3 are separated from elongate web 4 by longitudinal slots 11.

At their outer edges, the gliding members 2 and 3 are concavely curved to provide the waistline 9. The upper surface of the elongate web 4 serves as a support surface for a snow boarder and is provided with inserts 7 in the area where ski bindings are to be attached. In the area of the inserts 7, laterally of the snow board 1, there are provided height compensating support blocks or spacers 8 on the gliding members 2 and 3. The spacers 8 serve to support toe and heel sections of a user and thus directly transmit the movements of the user's foot to the gliding members of the snow board 1 and prevent unintended tilting movements.

What is claimed is:

1. A snow board with a divided gliding surface, comprising:

a basic body consisting of two gliding members and an elongate web provided between the gliding members, lateral slots being provided between the gliding members and the elongate web, and transition sites between the elongate web and forward and rear sections of the basic body, said transition sites being curved.

2. The snow board of claim 1, wherein the elongate web is structured as a support surface for a snow boarder and the slots between the gliding members and the elongate web have a height of up to 5 cm.

3. The snow board of claim 1, wherein the gliding members have a waistline extending in a longitudinal direction, and spacers arranged on surfaces of the gliding members.

4. The snow board of claim 1, wherein spacers are releasably connected with the gliding members.

5. A snow board, comprising:

an elongated unitary body of predetermined length forming first and second gliding members extending along opposite lateral margins thereof;

an elongate web extending between the first and second gliding members and being joined to forward and rear sections of the body in a curved transition and separated from the first and second gliding members by lateral slots.

6. The snow board of claim 5, wherein the elongate web protrudes from the surface of the body by from 3 to 5 cm.

7. The snow board of claim 6, wherein the elongate web is provided with means for connecting bindings.

8. The snow board of claim 7, wherein the means for connecting bindings comprises inserts.

9. The snow board of claim 7, further comprising spacers of a height substantially equal to a protrusion of the elongate web and attached to one of the gliding members and the bindings.

10. The snow board of claim 5, wherein the first and second gliding members have elongated lateral margins of concavely curved configuration.

* * * * *

UNITED STATES PATENT AND TRADEMARK OFFICE

CERTIFICATE OF CORRECTION

PATENT NO. : 7,581,747 B2
APPLICATION NO. : 10/553513
DATED : September 1, 2009
INVENTOR(S) : Patrick-Alexander Kosmehl It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 907 days.

Signed and Sealed this

Fourteenth Day of September, 2010

David J. Kappos

David J. Kappos
*Director of the United States Patent and Trademark Office*